United States Patent [19]

DeWallace

[11] 4,386,712

[45] Jun. 7, 1983

[54] SAFETY CLOSURE WITH LINER

[75] Inventor: Robert C. DeWallace, Toledo, Ohio

[73] Assignee: Owens-Illinois, Inc., Toledo, Ohio

[21] Appl. No.: 280,753

[22] Filed: Jul. 6, 1981

[51] Int. Cl.[3] ..... B65D 55/02

[52] U.S. Cl. ..... 215/211; 215/216; 215/350

[58] Field of Search ..... 215/211, 216, 341, 343, 215/344, 350, 351, 354

[56] References Cited

U.S. PATENT DOCUMENTS

| | | | |
|---|---|---|---|
| 4,004,704 | 1/1977 | Hilaire | 215/211 X |
| 4,053,078 | 10/1977 | Herr | 215/211 X |
| 4,280,631 | 7/1981 | Lohrman | 215/216 X |
| 4,322,012 | 3/1982 | Conti | 215/344 |

*Primary Examiner*—George T. Hall

*Attorney, Agent, or Firm*—J. R. Nelson; M. E. Click; D. H. Wilson

[57] ABSTRACT

A safety closure comprises a cap having a pair of locking lugs which engage complimentarily disposed camming surfaces on the associated container and a plug or valve style liner disposed within the cap. The liner includes a generally planar disk having a hollow cylindrical plug defining an outer surface having a compound taper and a conical projection spaced concentrically about said cylindrical plug. The liner extends into the finish of the container and seals it during axial translation of the closure corresponding to 180° or less rotation thereof. The liner, due to its simplicity, may be fabricated of material which exhibits resistance to the product within the container but which would otherwise be unsuitable or difficult to mold into the cap.

7 Claims, 4 Drawing Figures

SAFETY CLOSURE WITH LINER

BACKGROUND OF THE INVENTION

The invention relates generally to closures for containers and more specifically to closures having a plug or valve style liner.

Packages for poisons, chemicals and medications used both commercially and in the home typically include closures which require a certain degree of manual dexterity for their removal. Such dexterity is typically not exhibited by infants and those of similar intelligence who might not appreciate the possible dangers of the product contained therein. Furthermore, it is desirable that the closure be readily replaced on the container with simple, conventional movements known to all so that such replacement is encouraged in order to resecure the contents from accidental use.

Numerous types and designs of safety caps and cooperating container configurations are disclosed in the prior art. A significant distinction or means of grouping such configurations addresses whether the closure must provide a fluid tight seal in cases where the container will hold a liquid or simply close the container and provide a nominal seal to prevent discharge of pills, capsules, powders and the ingestion of foreign material.

Those devices constituting the first group have been the subject of much development effort which is well documented in the patent literature. For example, U.S. Pat. Nos. 3,830,391 to Uhlig, 3,941,268 to Owens et al. and 4,134,513 to Mumford are representative of such art. These patents are directed to various embodiments of closures which typically include a pair of opposed webs or lugs which coact with a pair of stepped, camming surfaces suitably disposed about the neck of the container. In order to remove the closure from the container, the closure must be squeezed at locations substantially intermediate the opposed lugs to increase the diameter of the cap adjacent the lugs. When the closure is rotated, the lugs clear the steps of the camming surfaces and permit removal of the closure from the container. Typically, the lugs and camming surfaces will extend and interfere over a certain axial distance so that the closure must be gripped and squeezed at least twice, an action which requires a certain amount of intelligence, dexterity and intent on behalf of the user. This cap design also satisfies requirements for quick and simplified resecurement to the container inasmuch as only conventional circular motion is required; the lugs now simply riding the camming surfaces without interfering with rotation of the closure.

Clearly such safety closures and related designs are somewhat more complex than conventional closures. The complexity of molds for such closures not only renders them expensive but frequently limits the particular material which may be utilized therein to fabricate the closure. These considerations become significant when it is appreciated that each distinct container configuration requires a distinct closure and thus mold, and that the limitation on material use may create difficulties if the only materials capable of being utilized in a given mold to fabricate a given closure are incompatible with, i.e., may be attacked by, the product which is to be placed in the subject container. Such difficulties suggest the utilization of a liner disposed within the closure structure, which is fabricated of material distinct from that of the closure proper. A closure having a liner is generally illustrated in U.S. Pat. No. 3,247,992.

As those familiar with closures which incorporate cooperating lugs and camming surfaces will appreciate, it is often possible to rotate the closure substantially but less than one-half turn before the lugs and steps of the camming surfaces engage and inhibit further rotation and removal of the closure. If the contents of the container is a liquid, such rotation may cause sufficient axial traverse of the closure to allow the liquid to escape. Depending upon the character of the liquid, this may or may not create difficulties. Nonetheless, it is often desirable to preclude such leakage. The previously referenced U.S. Pat. No. 4,134,513 discloses a plug style closure which provides a seal over a substantial portion of the rotation and thus axial traverse of the closure on the container finish.

SUMMARY OF THE INVENTION

A safety closure comprises a closure body having a pair of radially oriented locking lugs disposed on an inner surface which engage a complementarily disposed pair of stepped camming surfaces on the associated container and a plug or valve style liner which extends into the finish of the container and provides a seal during a portion of the rotation and axial traverse of the closure on the container. The liner is disposed within the upper portion of the closure body and restrained there by a rib on the inner cylindrical surface of the closure body. The closure body may be fabricated on any conventional material such as polyethylene which may or may not be compatible with and resistant to the contents of the container whereas the liner may be fabricated of an appropriately compatible, resistant material. The liner includes a generally planar disk having a concentrically disposed hollow cylindrical plug extending from one face. The cylindrical plug defines an outer surface having a compound taper. The liner also includes a circular rib projecting from the planar disk. The rib has a generally triangular cross-section and is spaced concentrically about the cylindrical plug. Due to its simplicity, the liner may be fabricated of a material which exhibits resistance to the product within the container but which might be mechanically unsuitable, excessively expensive or difficult to mold into an entire closure.

Several advantages devolve from this construction. First of all, a specific liner may be utilized with various sizes of closure bodies matched to the requirements of given containers or product lines for aesthetic or other reasons. This is important not only from the standpoint of reducing expenses associated with the production and design of multiple molds but furthermore because it separates the functional and mechanical aspects of the seal from the design and aesthetic aspects of the closure body. One may thus be modified without affecting the other.

Secondly, the configuration allows a broader choice of materials. Since substantially only the liner is constantly exposed to the material within the container only the material from which it is fabricated need be selected for its service characteristics such as corrosion resistance and freedom from chemical attack. The simplicity of the liner further broadens the choice of materials. Since only the liner material must be selected for appropriate chemical characteristics, design freedom is enhanced since the selection of materials for the closure body may be based upon a broad range of considerations such as aesthetics, service life, cost, etc.

Finally, since the liner is relatively freely disposed within the closure body, the torque required to initially free the closure is minimized since such torque is almost solely the result of and directed to releasing engagement between the closure body and the finish rather than between the liner and the finish. If the liner has become lodged on the finish, increased torque requirements associated with its release will only occur after the closure body has been rotated a distance sufficient to cause axial engagement of the lip on the inner surface of the closure body with the periphery of the liner. Subsequent to such engagement, additional axial traverse of the cap body will dislodge the liner from the container finish. Clearly, the additional torque requirement associated with release of the liner from the finish will occur subsequent to the torque application associated with initial freeing of the closure body from the container finish and thus the overall average torque requirement associated with the removal of a closure according to the instant invention from a container is reduced.

Thus it is an object of the instant invention to provide a safety closure for a container.

It is a further object of the instant invention to provide a safety closure having a liner.

It is a still further object of the instant invention to provide a closure having a liner and plug which maintain a liquid tight seal during at least a portion of the axial traverse of the closure on the container finish.

It is a still further object of the instant invention to provide a closure body and liner which may be fabricated of distinct materials in order to provide distinct aesthetic and mechanicl requirements.

Still further objects and advantages of the instant invention will become apparent by reference to the following specification and attached drawings.

DESCRIPTION OF THE PREFERRED EMBODIMENT

Figure 1:
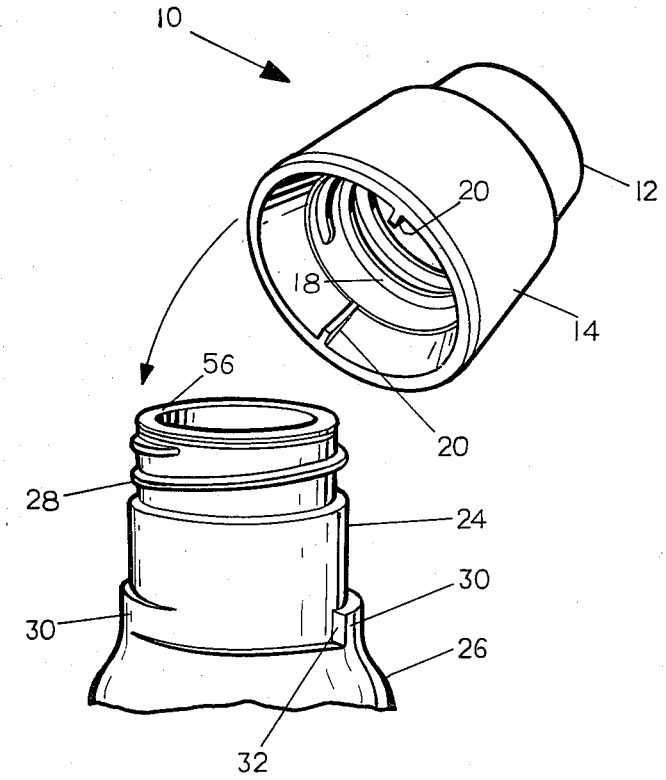
FIG. 1 is a fragmentary perspective view of a closure according to the instant invention and finish of a cooperating container.
Figure 2:
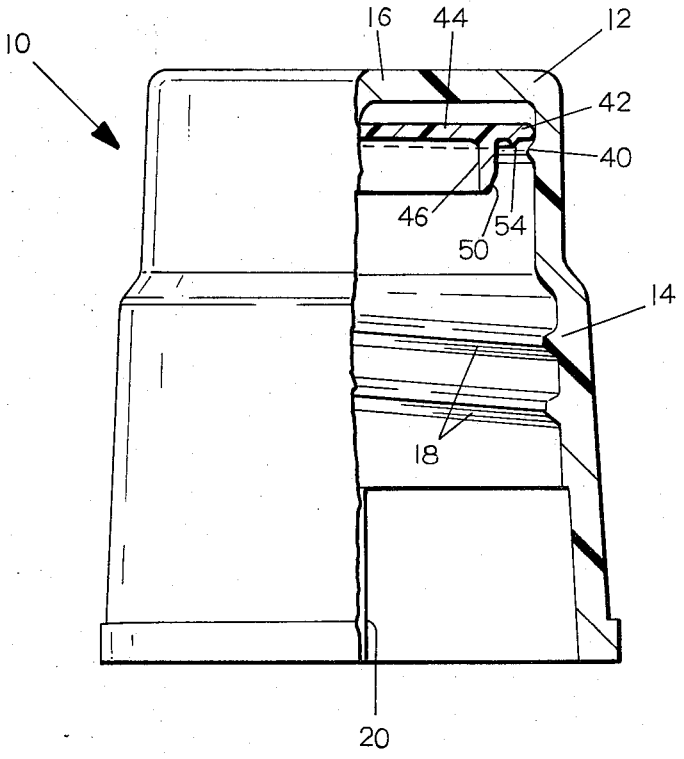
FIG. 2 is a half-sectional view of a safety closure according to the instant invention.

Referring now to FIGS. 1 and 2, a safety closure assembly according to the instant invention is generally designated by the reference numeral 10. The safety closure assembly 10 includes a cap or closure body 12. The closure body 12 defines a circumferentially extending skirt or wall section 14. The wall section 14 may be generally frusto-conical and stepped as illustrated, cylindrical, combinations thereof or other configurations suitable for such use. A generally planar top panel 16 merges with the wall section 14 and closes off one end of the closure body 12. The inner surface of the wall portion 14 includes female threads 18 and an opposed pair of radially disposed generally triangular webs or lugs 20.

In FIG. 1, the finish 24 of a container 26 with which the safety closure assembly 10 may be utilized is illustrated. The finish 24 includes complementarily disposed and configured male threads 28 which engage the female threads 18 within the closure body 12 and, upon suitable relative rotation, secure or release the safety closure assembly 10 from the container 26. The container 26 also includes a pair of opposed ramp or camming surfaces 30 disposed adjacent the male threads 28. The camming surfaces 30 are diametrically opposed and include correspondingly opposed discontinuities or steps 32 which cooperate with the lugs 20 of the closure body 12 to provide a safety removal feature. Basically, the lugs 20 engage and ride along the camming surfaces 30 as the closure body 12 is threaded onto the container 26. A closure body 12 having threads of conventional right hand sense which require that the closure body 12 be rotated clockwise to secure it is illustrated and thus the camming surfaces 30 and the lugs 20 do not interfere with such securement. However, in order to remove the closure body 12 from the container, the closure body 12 must be squeezed at diametrically opposed locations substantially at right angles to the lugs 20 such that the outer wall 14 of the closure body 12 in the region adjacent the lugs 20 bulges in order to permit the lugs 20 to clear the steps 32 while the closure body 12 is being rotated and thus removed from the container 26. Inasmuch as this general closure scheme is well documented in the prior art, it will not be further described here. Reference to U.S. Pat. No. 3,941,268 will further clarify this safety closure feature and operation.

Referring now to FIG. 2, the closure body 12 also includes an inwardly directed circumferential rib or projection 40 generally adjacent the top panel 16 of the closure body 12. The projection 40 retains a valve or plug style liner 42. The liner 42 is relatively loosely disposed within the closure body 12 and is free to rotate relative thereto as well as translate axially between the inner surface of the top panel 16 and the projection 40.

Figure 3:
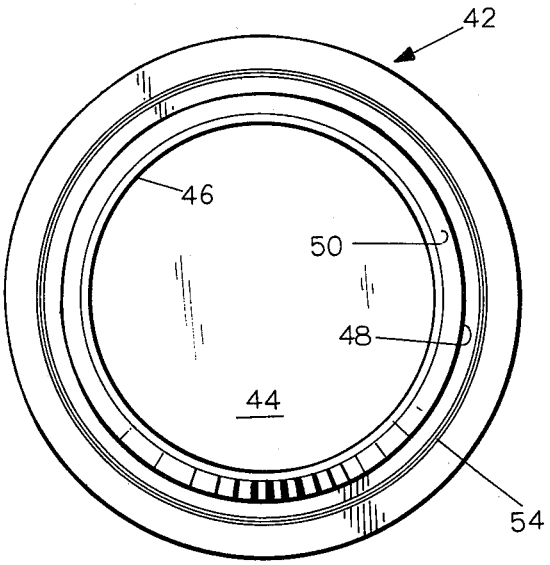
FIG. 3 is a bottom plan view of a safety closure liner according to the instant invention.
Figure 4:
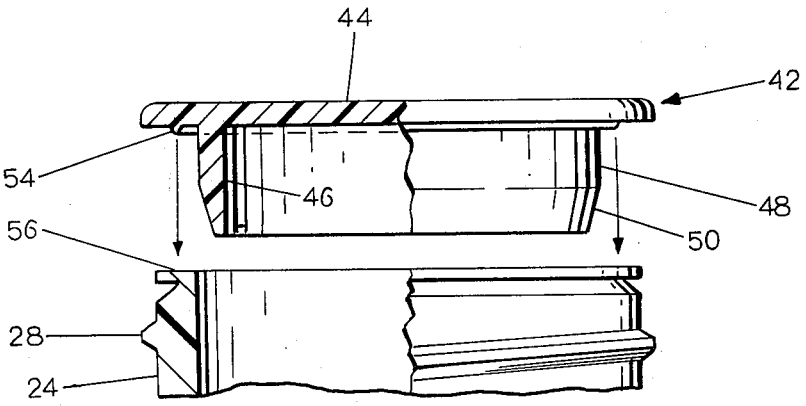
FIG. 4 is a half-sectional view of a safety closure liner according to the instant invention and portion of a container finish.

Referring now to FIGS. 3 and 4, the liner 42 is preferably circular in construction and includes generally planar disk portion 44 and a cylindrical plug or wall portion 46 disposed generally coaxially with the axis of the disk portion 44. The outer surface of the wall portion 46 defines a first generally cylindrical region 48 which is sized to fit and seal within the opening of the finish 24 of the container 26 and a frusto-conical region 50 which tapers to a diameter smaller than such opening diameter in order to facilitate insertion of the liner 42 within such opening. The surface 48 preferably defines a very slight taper on the order of 1° such that the outside diameter of the wall portion 46 decreases with increasing distance from the planar disk portion 44. The frusto-conical region 50 is disposed at a substantially greater angle on the order of 15°. The planar disk portion 44 also includes a rib or projection 54 concentrically disposed about the wall portion 46. The projection 54 is preferably triangular in cross-section. The diameter of the projection 54 is selected to match or substantially match the median diameter of the radially extending end face 56 of the finish 24 of the container 26 with which the safety closure assembly 10 is to be utilized.

A safety closure assembly 10 according to the instant invention exhibits several benefits. First of all, since the liner 42 is both the only component of the assembly 10 to come into significant contact with the contents of the container 26 and since it is a significantly less complex shape than other closures, it may be fabricated of a material which for various reasons such as economy and molding difficulties would be unsuitable if used for the entire closure body 12. Thus increased choice of materials is achieved. For example, whereas the closure body 12 may be molded of conventional materials such as polyethylene which has unacceptably low resistance to attack by certain chemicals, the liner 42 may be fabricated of such materials as Barex. Barex is the trade name for an acrylonitrile barrier polymer manufactured by the Vistron Division of the Sohio Oil Company. Other materials having suitable resistance to the intended contents of the container 26 and which might not otherwise be a suitable material from which to mold the entire closure 12 may be readily utilized in the fabrication of the liner 42.

As is apparent from the drwing figures, the wall portion 46 of the liner 42 extends into the opening of the finish 24 of the container 26 a substantial axial distance. It is preferable, though not necessary, that this axial distance be equal to or greater than the axial distance traversed by the closure body 12 as it is threaded one-half turn on or off the container finish 24. So configured, the liner 42 maintains sealing engagement with the finish 24 of the container 26 in spite of the fact that the closure body 12 may have been rotated from a random circumferential position at which the lugs 20 were initially located, through an angle of less than 180° until the lugs 20 abut and are restrained by the steps 32. Thus, in spite of the fact that the closure body 12 has undergone a certain amount of rotation, such rotation being less than 180° and thus generally insufficient to remove the closure 12 from the container 26, a situation which might occur when an infant or other person attempted to remove the safety closure assembly 10, a seal between the liner 42 and mouth of the finish 24 of the container 26 would be maintained.

The safety closure 10 also exhibits certain advantages regarding reduced torque requirements while opening. It may be appreciated that a peripheral problem of child proof and other types of safety closures is a certain amount of difficulty relating to closure removal encountered by weak and aged persons who are capable of appreciating the possible hazards of the contents of the container 26. Such difficulty and attendant frustration may result in attempts to circumvent the safety features and thus render unauthorized users as exposed to hazards as they would be with a conventional, non-safety closure. With the assembly 10 of the instant invention, the liner 42, as has been previously described, is restrained within the closure body 12 but free to rotate and translate axially over a certain limited distance. Due to this motion freedom, initial torque applied to the closure body 12 is utilized almost entirely to free the closure body 12 from the finish 24 of the container 26 rather than to free or partially remove the liner 42 from within the opening of the finish 24. Subsequent to freeing the closure body 12, it will commence axial translation as it is rotated. If the liner 42 is tightly sealed against the finish 24 of the container 26, torque increase associated with its release will not occur until the liner 42 contacts and is axially translated by the projection 40 within the closure body 12. At this time, some additional torque may be required in order to release the liner 42 from the finish 24 but such an event will occur significantly after the closure body 12 has been freed from the finish 24. Thus, the maximum torque requirements associated with removal of the closure body 12 from the container 26 will not only be lowered but also such maximum torque requirement will not occur at the same moment as the squeezing of the closure body 12 must be effected in order to release the lugs 20 from the steps 32.

Finally, the projection 54 should be noted. The projection 54 provides a tight compressible seal against the face 56 of the finish 24 and further ensures against the possibility of escape of the contents of the container 26 when the closure assembly 10 is securely seated on the finish 24.

The foregoing disclosure is the best mode devised by the inventor for practicing this invention. It is apparent, however, that devices incorporating modifications and variations will be obvious to one skilled in the art of safety closures. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. A closure for a container having a neck including a radial annular rim surface defining the container opening, comprising, in combination, a closure body having a top panel and a sidewall depending therefrom, said sidewall having means for securing said closure body to the neck of said container and a circumferential retainer rib defining a retaining channel adjacent said top panel, a liner disposed within said retaining channel, said liner including a planar circular disk and a depending plug defined by a cylindrical wall normal to the underside of said disk and coaxial with the center axis of said disk for sealing engagement with said neck below the opening of said container, said cylindrical wall having a straight inner surface and a compound tapered outer surface, the first tapered region of said outer surface adjacent said disk being of a diameter to fit and seal inside the neck opening of the container below said rim and the lower tapered region being a frusto-conical surface smaller than the opening of the container, and an annular V-shaped rib depending from the underside of said disk concentrically about said cylindrical wall and located for sealing engagement on said rim surface of the container neck.

2. The closure of claim 1 wherein said closure body is comprised of a first material comprised of a thermoplastic composition selected for its mechanical and aesthetic properties, and said liner is comprised of a second material comprised of a plastic polymer composition selected for its functional compatability in sealing a product in the container.

3. The closure of claim 2 wherein said first material is polyethylene and said second material is acrylonitrile barrier polymer.

4. The closure of claim 1 wherein the first outer surface region of the cylindrical wall is tapered inwardly at an angle of approximately 1° to the center axis of said disk portion and the second outer surface region of said cylindrical wall is tapered inwardly at an angle at least equal to 15° toward said center axis, and wherein said liner is disposed for rotation and axial movement with respect to the top panel of the closure body and the retainer rib on the inner surface of its sidewall.

5. The closure of claim 4 in which the means on the closure body for securing it to the neck of the container comprises threads on the inner wall of the closure sidewall and corresponding threads on the exterior of the neck and wherein axial length of said cylindrical wall of said liner is greater than the axial translation resulting from 180° of rotation of said closure body on the threads of the container neck.

6. A closure for a container having a neck including a radial annular rim surface at the end opening thereof, comprising, in combination, a closure body molded of a first material and having a top panel and a sidewall extending therefrom, said sidewall having an inner surface including thread means for securing said closure body to such container and an inwardly directed circumferential rib spaced below said top panel defining a retaining channel, and a liner retained in said retaining channel, said liner being molded of a second plastic material comprised of a plastic and distinct from said first material and including a planar disk and a downwardly depending cylindrical wall concentric about the center axis of said disk, said cylindrical wall including a first outer surface region adjacent said planar disk disposed substantially parallel to said center axis and a second outer surface region of frusto-conical contour disposed below said first region and having an angle of taper of approximately 15° toward said center axis, the axial length of said cylindrical wall being greater than one-half the lead dimension of said thread means, and a circular V-shaped rib disposed on the underside of said disk concentrically about said cylindrical walls, whereby the V-shaped rib is located for sealingly engaging the radial rim surface of the neck.

7. The closure of claim 6 in which the first material comprises polyethylene and the second material comprised of a plastic is acrylonitrile barrier polymer.

* * * * *